US009579002B2

(12) United States Patent
Smith

(10) Patent No.: US 9,579,002 B2
(45) Date of Patent: Feb. 28, 2017

(54) APPARATUS, SYSTEM AND METHOD FOR TRANSPORTING A POTTY SEAT

(75) Inventor: Kelly Leigh Smith, Kernersville, NC (US)

(73) Assignee: Tottigo, LLC, Kernersville, NC (US)

( * ) Notice: Subject to any disclaimer, the term of this patent is extended or adjusted under 35 U.S.C. 154(b) by 821 days.

(21) Appl. No.: 13/588,659

(22) Filed: Aug. 17, 2012

(65) Prior Publication Data

US 2013/0042401 A1 Feb. 21, 2013

Related U.S. Application Data

(60) Provisional application No. 61/575,413, filed on Aug. 19, 2011, provisional application No. 61/685,005, filed on Mar. 9, 2012.

(51) Int. Cl.
*A47K 13/00* (2006.01)
*A47K 11/06* (2006.01)

(52) U.S. Cl.
CPC ..... *A47K 11/06* (2013.01)

(58) Field of Classification Search
USPC ..... 4/245.1–245, 239; 383/4
See application file for complete search history.

(56) References Cited

U.S. PATENT DOCUMENTS 4,085,873 A 4/1978 Schweitzer
4,188,988 A 2/1980 Agyagos
4,930,165 A * 6/1990 Wilson ..... 4/235
5,193,229 A * 3/1993 Smith ..... 4/245.5
5,618,110 A * 4/1997 Sullivan ..... A45C 3/10 224/153
5,809,584 A * 9/1998 Potts ..... 4/254
6,000,068 A 12/1999 Chavis
6,389,612 B1 * 5/2002 Harris ..... 4/239
6,393,638 B1 * 5/2002 MacColl ..... A45F 4/02 383/4
2002/0184701 A1 * 12/2002 Johnson ..... 4/245.5

OTHER PUBLICATIONS

Non-Final Office Action for U.S. Appl. No. 14/522,919, mailed Jan. 15, 2016, 14 pages.
Final Office Action for U.S. Appl. No. 14/522,919, mailed Jun. 16, 2016, 14 pages.
Advisory Action for U.S. Appl. No. 14/522,919, mailed Sep. 15, 2016, 3 pages.
Notice of Allowance for U.S. Appl. No. 14/522,919, mailed Oct. 21, 2016, 7 pages.

* cited by examiner

*Primary Examiner* — Lauren Crane
(74) *Attorney, Agent, or Firm* — Withrow & Terranova, P.L.L.C.

(57) ABSTRACT

An apparatus, system and method for transporting a potty seat. The apparatus can include a container, the container including a first end having an opening defined therein, a second end disposed opposite the opening, a sidewall extending between the first end and the second end, and defining an interior cavity enclosed by the first end, the second end, and the sidewall, an interior surface, an exterior surface, and an internal flap disposed within the cavity and having a first end coupled to and extending away from the second end of the container, the internal flap being adapted to be detachably coupled to a portion of a potty seat.

21 Claims, 20 Drawing Sheets

APPARATUS, SYSTEM AND METHOD FOR TRANSPORTING A POTTY SEAT

CROSS-REFERENCE TO RELATED APPLICATIONS

This application claims priority to U.S. Provisional Application No. 61/575,413, filed Aug. 19, 2011 and entitled Multifunctional Container for a Potty Seat, and to U.S. Provisional Application No. 61/685,005, filed Mar. 9, 2012 and entitled Multifunctional Container for a Potty Seat, the entire contents of which are hereby incorporated by reference.

BACKGROUND

Transitioning a child from diapers to underwear is often a challenging process. A particular challenge involves teaching the child how to properly use a conventional toilet. Many children are fearful of sitting on a toilet because the hole in the toilet seat is substantially larger than the child's buttocks. Thus, children are fearful of falling into the toilet. To mitigate this fear, potty seats were invented.

A conventional, portable potty seat (henceforth referred to as a "potty seat") is designed to sit on top of the toilet seat. The outer circumference of the potty seat is of sufficient size to rest on the toilet seat while the inner circumference is small enough to support a young child's buttocks thereby eliminating the risk of a child falling into the toilet.

Potty seats work well when they are being used at home where the toilet seat and surrounding areas of the toilet are generally clean. However, using a potty seat in public restrooms where the toilet is often unsanitary is problematic for several reasons. First, one is confronted with cleaning at least the upper surface of the public toilet seat to avoid placing the potty seat on top of an unclean surface. This scenario is particularly alarming considering that although the potty seat provides a sanitary surface upon which the child rests; the child's legs and hands are still exposed to the unsanitary surroundings of the toilet. Secondly, once the potty seat has been used on an unsanitary public toilet, one has to then transport the soiled potty seat. Typically, the soiled potty seat is transported in a diaper bag or other containers of sufficient size to hold the potty seat.

Several solutions exist to combat these problems. For example, some public restrooms offer paper covers for the toilet seat. These paper toilet seat covers are usually half folded and made to fit directly on top of the toilet seat. The covers are dispensed from a container typically positioned adjacent to the toilet. Whereas paper covers are convenient and can be readily disposed of in the toilet, these covers fit awkwardly beneath a potty seat. Furthermore, the paper covers do not eliminate the child's exposure to other unsanitary, uncovered surface areas of the toilet.

Other solutions focus on the transport of potty seats. The prior art in this area shows various potty seat designs which allow the potty seat to fold for ease of storage and transport. Some of the designs include a container into which the folded potty seat is placed. These designs address aspects of the aforementioned problem by providing containers that isolate the soiled or contaminated potty seat after use. However, these designs fall short of mitigating the child's exposure to unsanitary conditions around the potty seat.

Accordingly, there still remains a need for a potty seat container that: (1) attaches to the potty seat; (2) shields the child from unsanitary surfaces of the toilet when the potty seat is in use; and, (3) enables the sanitary transport of the potty seat.

SUMMARY

According to at least one exemplary embodiment, a container for a potty seat may be disclosed. The apparatus can include a container, the container including a first end having an opening defined therein, a second end disposed opposite the opening, a sidewall extending between the first end and the second end, and defining an interior cavity enclosed by the first end, the second end, and the sidewall, an interior surface, an exterior surface, and an internal flap disposed within the interior cavity and having a first end coupled to and extending away from the second end of the container, the internal flap being adapted to be detachably coupled to a portion of a potty seat.

BRIEF DESCRIPTION OF THE DRAWINGS

Embodiments of the present invention will be more readily understood by reference to the following figures, in which like reference numbers and designations indicate like elements.

DETAILED DESCRIPTION OF THE INVENTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention. Whenever possible, like reference numbers will be used to refer to like components or parts.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Exemplary embodiments disclosed in this detailed description include a multipurpose container for a potty seat. The multifunctional container may be configured to contain a potty seat, serve as a sanitary cover or shield to protect the user of the potty seat from unsanitary surfaces of the toilet, and, in some exemplary embodiments, provide a compartment for storing personal items. Other embodiments and features include various structures and means for configuring the multifunctional container and for attaching the multifunctional container to the potty seat.

Figure 1B:
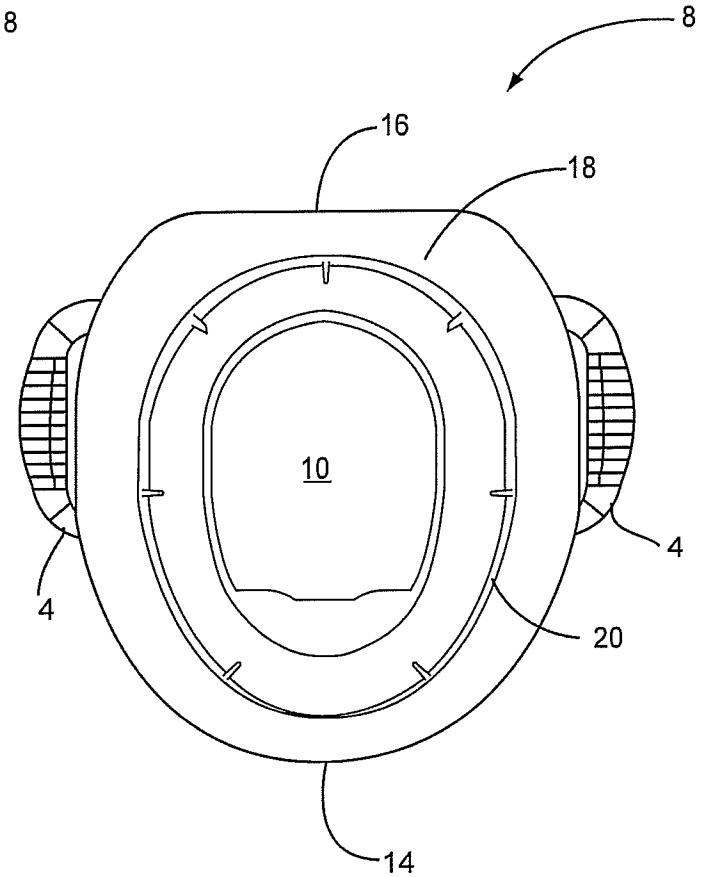
FIGURE 1B (RELATED ART)
FIG. 1B is a bottom surface view of the potty seat which illustrates the portion of the potty seat that rests on the toilet.
Figure 1A:
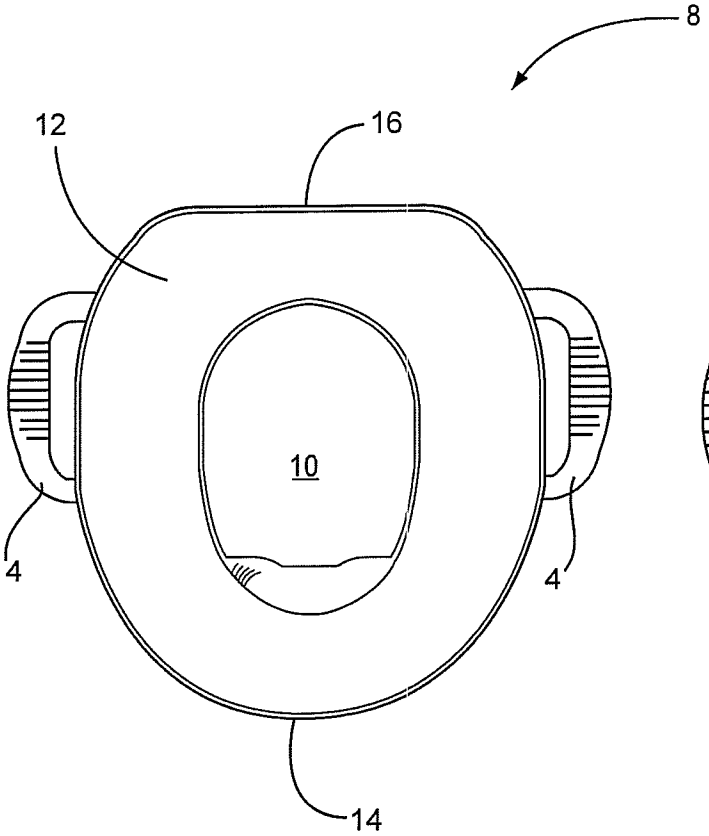
FIGURE 1A (RELATED ART)
FIG. 1A is a top surface view of a potty seat which illustrates the portion of the potty seat where a child sits.

FIG. 1A illustrates a top view of an exemplary potty seat 8. The potty seat 8 can have a ring-shaped perimeter surrounding a main aperture 10 and a top surface 12, which may be soft, on which the child sits. The potty seat can further include a pair of handles 4. The front 14 of the potty seat 8 can be substantially curved and the rear 16 of the potty seat 8 can be generally straight. FIG. 1B illustrates a bottom view of the potty seat 8. The bottom surface 18 of the potty seat 8 can be substantially flat. Protruding from the flat bottom surface 18 may be a support ring 20. The support ring 20 may extend into the main opening of the toilet seat 45 (shown in FIG. 5) on which the potty seat 8 rests. The support ring 20 can keep the potty seat 8 from sliding off the toilet seat 45 while the child sits on the potty seat 8.

Figure 2:
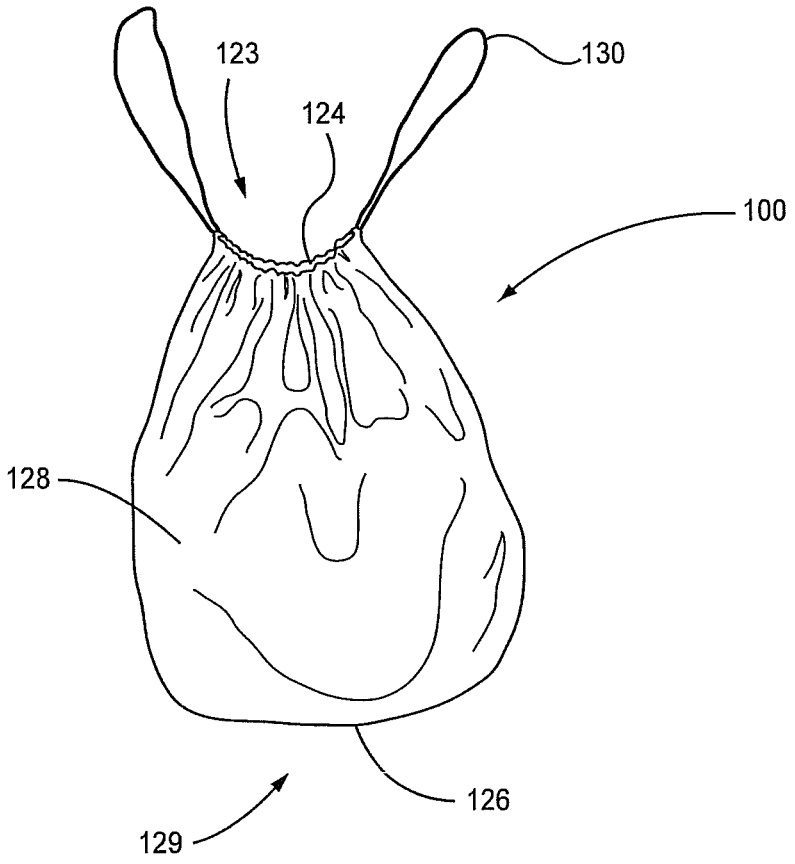
FIG. 2 illustrates an exemplary embodiment of a multifunctional container in which a potty seat can be enclosed.

FIG. 2 illustrates a perspective view of an exemplary embodiment of a multifunctional container 100. The multifunctional container 100 can have a predetermined volume sufficient to contain the potty seat 8 and an opening 124 through which the potty seat can be extracted and inserted. The opening 124 can be located at a first end 123 of the multifunctional container 100. The multifunctional container can further include an exterior base 126 and a sidewall 128 enclosing an interior cavity of container 100. The exterior base 126 can be located at a second end 129 of the container 100 substantially opposite the opening. In some exemplary embodiments, the sidewall 128 and exterior base 126 of the multifunctional container 100 can be permanently coupled to each other. Those skilled in the art, however, will recognize that the sidewall 128 and exterior base 126 could be coupled using zippers or any other fastener known in the art. Moreover, in an exemplary embodiment of the invention, the opening 124, when expanded, can be wider than the exterior base 126, thereby making it easier to maneuver the potty seat 8 in and out of the multifunctional container 100. In yet another exemplary embodiment of the invention, the multifunctional container 100 can include straps (not shown) that allow the multifunctional container 100 to be carried as a backpack or book bag. As will be discussed infra, located at the exterior base 126 but on the interior of the multifunctional container 100 can be structures for attaching the multifunctional container 100 to the potty seat 8.

The opening 124 of the multifunctional container 100 can be selectively closable and can include drawstring 130. The drawstring 130 may allow the opening 124 of the multifunctional container 100 to be fully opened or securely closed. Once the multifunctional container 100 is fully opened, the potty seat 8 can be freely inserted into the multifunctional container 100 or partially or fully removed from the multifunctional container 100. Alternatively, those skilled in the art will recognize that instead of using a drawstring 130, other suitable material may be used to close the opening 124 of the multifunctional container 100 including, but not limited to, Velcro, magnets, twists, handles, zippers, buttons, snaps, and ties.

Figure 3:
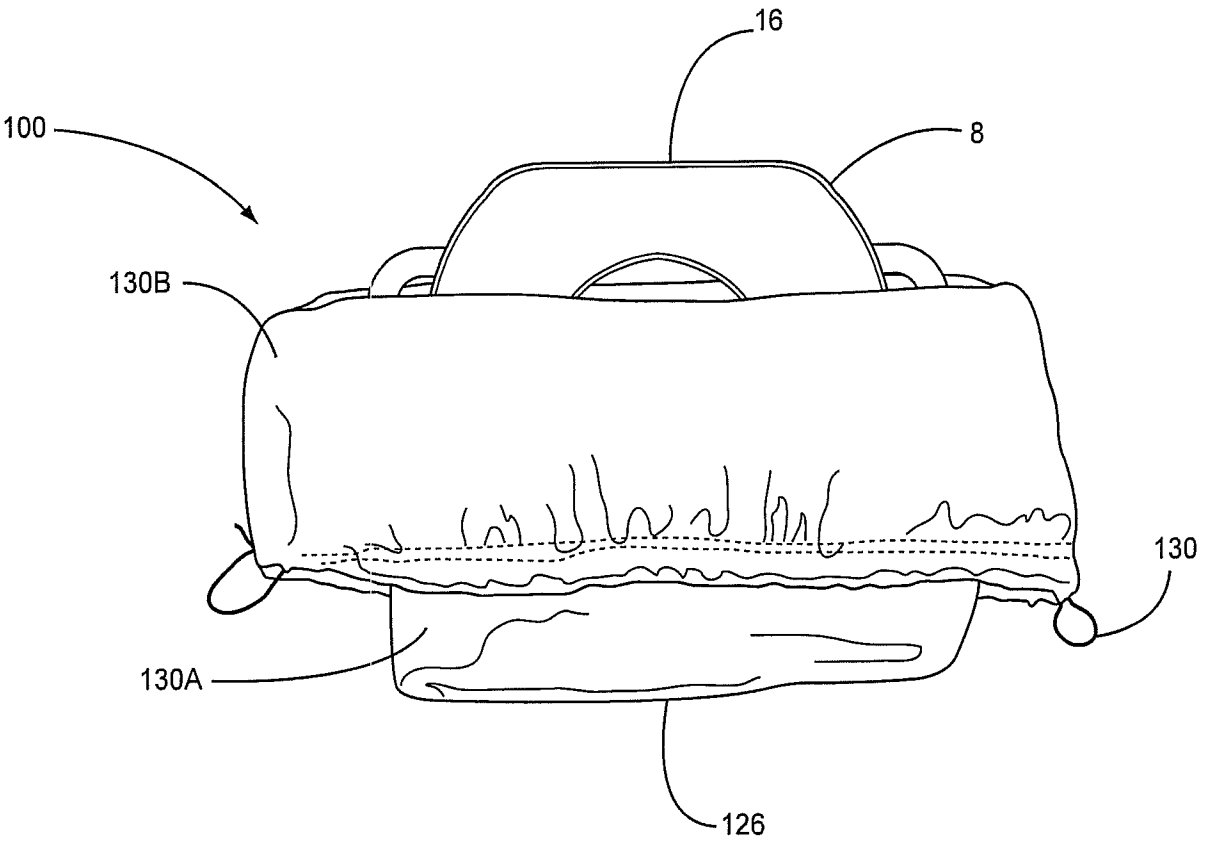
FIG. 3 is an open view of an exemplary embodiment of a multifunctional container which exposes the rear of the enclosed potty seat.

As illustrated in FIG. 3, the multifunctional container 100 can include an exterior surface 130A and an interior surface 130B. For example, the sidewall 128 may have an exterior surface 130A and interior surface 130B. In an embodiment of the invention, the exterior surface 130A and the interior surface 130B may be made of different materials which are sewn, glued, pressed, or meshed together. For example, in an embodiment of the invention, the interior surface 130B may be made from or treated with an antimicrobial material whereas the exterior surface 130A may be made from a designer fabric with aesthetic appeal. Since the interior surface 130B of the multifunctional container 100 touches the potty seat 8 and, as will be explained infra, the surfaces of the toilet 44 (See FIG. 5), the antimicrobial material can kill or inhibit the growth of bacteria originating from these surfaces.

In some exemplary embodiments, the interior surface 130B of the multifunctional container 100 may be made of material including, but not limited to, vinyl, canvas, nylon, polyester, plastic, or other water resistant or waterproof material capable of being easily cleaned or sanitized with disinfecting wipes. The exterior surface 130A may be made from material that has a greater aesthetic appeal such as cotton, nylon, leather, silk, fleece, velour, chenille, or suede. Notwithstanding the foregoing, to aid in reducing manufacturing costs, one skilled in the art will recognize that the exterior surface 130A and the interior surface 130B can be made of the same material or unitary fabric.

As further illustrated in FIG. 3, the potty seat 8 may be oriented inside the multifunctional container 100 such that the front 14 (covered by multifunctional container 100) of the potty seat 8 faces the interior base 132 (FIG. 4) of the multifunctional container 100 and the rear 16 of the potty seat 8 faces the opening 124 of the multifunctional container 100 when the multifunctional container 100 is closed. When the potty seat 8 is pulled from the multifunctional container 100, the interior surface 130B of the multifunctional container 100 can be exposed. Thus, the multifunctional container 100 is being turned "inside out." As will be described later, the potty seat 8 may be restrained from being completely removed from the multifunctional container 100 as a portion of the interior surface 130B of the multifunctional container 100 is detachably coupled to the potty seat 8.

Figure 4:
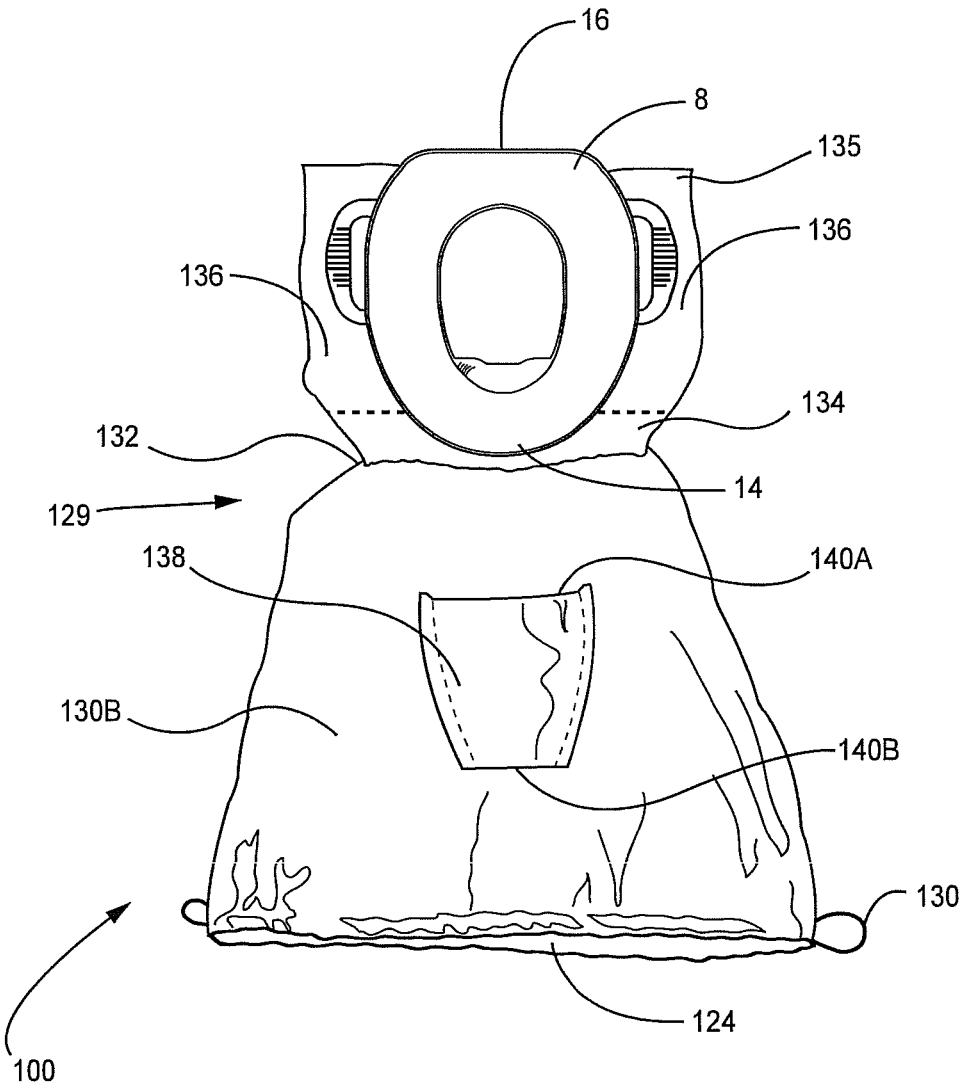
FIG. 4 is a top view of the potty seat with an exemplary embodiment of a multifunctional container folded back from the top surface of the potty seat while remaining detachably coupled to the bottom of the potty seat.

FIG. 4 illustrates a fully exposed potty seat 8 and the interior surface 130B of the multifunctional container 100. The front 14 of the potty seat 8 can face an interior base 132 of the multifunctional container 100. A portion of the interior surface 130B of the multifunctional container 100 may be detachably coupled to the potty seat via an internal flap 134. In some exemplary embodiments, the internal flap 134 may be coupled to the interior base 132 at second end 129 of the multifunctional container 100. In other exemplary embodiments, the interior flap 134 can be a continuous, unitary part of the interior base 132 of the multifunctional container 100. In another exemplary embodiment of the invention, side panels 136 may be coupled to, or may be a continuous part of, the interior flap 134. Internal flap 134 may have a first end 135 extending away from second end 129 of multifunctional container 100.

The side panels 136 may also be detachably coupled to the bottom surface 18 of the potty seat 8 as will be described in more detail below. The attachment of the interior flap 134 and side panels 136 can facilitate maintaining the orientation of the potty seat 8 and can facilitate keeping the potty seat 8 firmly coupled to the multifunctional container 100. Moreover, in an exemplary embodiment of the invention, the side panels 136 may be multilayered. For example, the layer of material that touches the toilet 44 when the potty seat 8 is in use may be made from material that can be readily and easily sanitized with disinfecting wipes. The layer of material that does not make direct contact with the toilet 44 may be made of other material that has a better aesthetic appeal.

In some exemplary embodiments of the invention, a pocket 138 may be sewn on the interior surface 130B of the multifunctional container 100. Those skilled in the art will realize that pockets may be placed in other locations on the interior and/or exterior surfaces of the multifunctional container 100 as well. The pocket 138 can be oriented such that the open end 140A of the pocked faces the front 14 of the exposed potty seat 8 and the closed end 140B of the pocket 138 faces the opening 124 of the multifunctional container 100. Accordingly, when the potty seat 8 is inside of the multifunctional container 100 and the multifunctional container 100 is closed and held in an upright position by the drawstring 130, the open end 140A of the pocket 138 may face downward. However, when the potty seat 8 is pulled out of the multifunctional container 100, as shown in FIG. 4, and placed on a toilet 44 (See FIG. 5), the open end 140A of the pocket 138 may face upward. Thus, items such as, wipes, toilet paper, hand sanitizer, or other personal items can be stored in the pocket 138 without fear of the items spilling. The items are also easily and conveniently accessible when the multifunctional container 100 is in use. In some exemplary embodiments, the open end 140A of the pocket 138 can further include closures (not shown) such a flap, buttons, snaps, zippers, hook-and-loop fasteners, or any other known closure to facilitate maintaining items within pocket 138.

Figure 5:
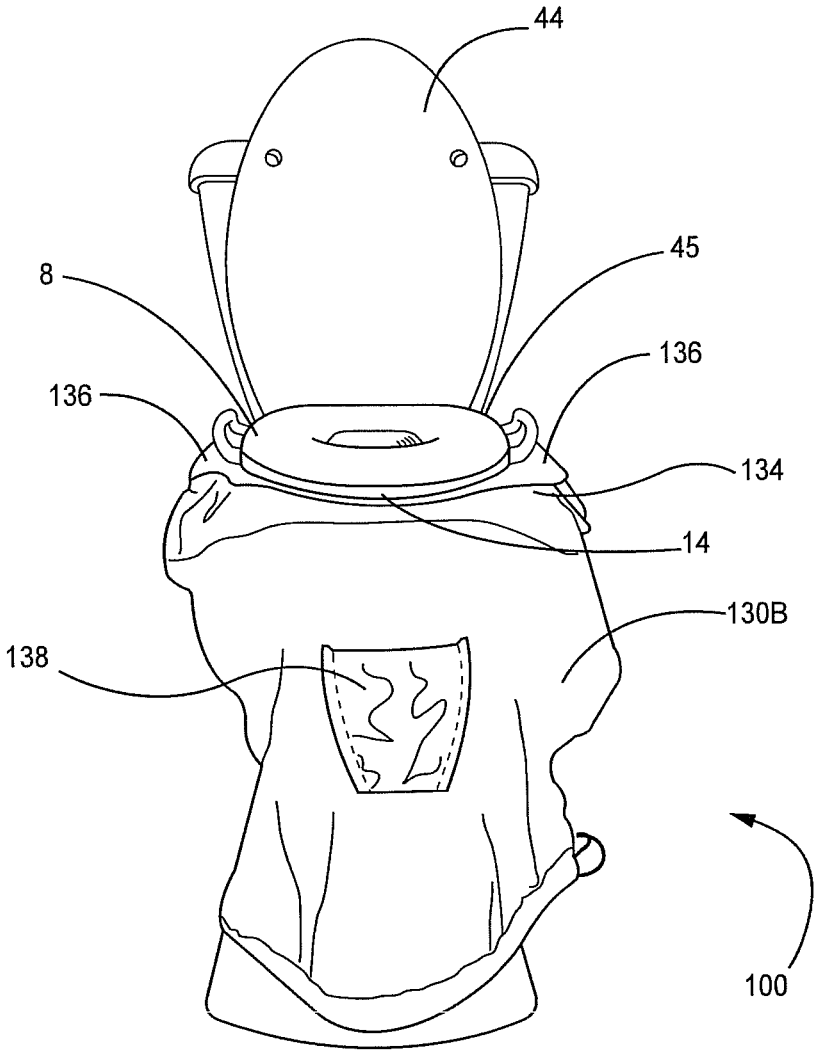
FIG. 5 is a perspective view of a potty seat an exemplary embodiment of a multifunctional container positioned on a toilet seat with the multifunctional container turned inside out thereby shielding unsanitary surfaces of the toilet.

FIG. 5 illustrates a perspective view of an exemplary embodiment of the invention placed on a toilet 44. Here, the potty seat 8 has been pulled out of the multifunctional container 100 with the multifunctional container 100 still coupled to the potty seat 8 via the internal flap 134. The potty seat 8 can be placed on the toilet 44 with the front 14 of the potty seat 8 facing the front of the toilet 44. The interior surface 130B of the multifunctional container 100 can drape over the front of the toilet 44 thereby shielding the child's legs from the surfaces of the toilet 44. The side panels 136 can drape over exposed sides of the toilet 44 in areas where a child's hands are commonly placed. Thus, the side panels can further mitigate the exposure the child has to unsanitary surfaces of the toilet 44. Furthermore, the pocket 138, as described above, can be conveniently positioned to allow an attendant of the child to retrieve items that may aid in the care of the child.

Figure 6:
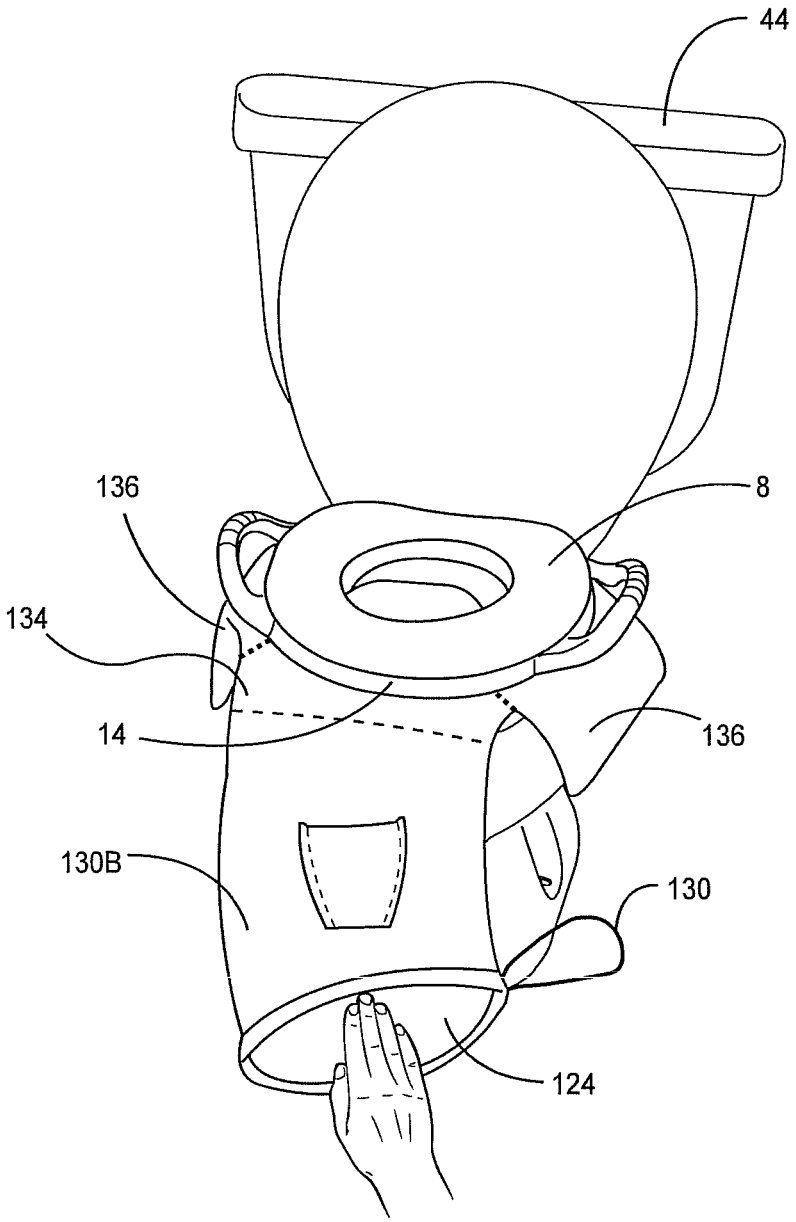
FIG. 6 is a perspective view illustrating a manner of removing a potty seat from a toilet by inserting ones hand into an opening in an exemplary embodiment of a multifunctional container, grabbing the potty seat, and holding the potty seat upward and letting the multifunctional container drape over the potty seat.

FIG. 6 illustrates a perspective view of an exemplary embodiment of the invention being removed from the toilet 44. To remove the potty seat 8 from the toilet 44, one can reach inside the multifunctional container 100 via opening 124 and grabs the front 14 of the potty seat 8. The front 14 of the potty seat 8 can be felt through the fabric of the interior base 132 and external base 126 of the multifunctional container 100. While firmly holding the potty seat 8, the potty seat 8 may be lifted from the toilet and rotated such that the rear 16 of the potty seat faces downward. The downward position of the rear 16 of the potty seat 8 can allow the opening 124 of multifunctional container 100 to drape or fall back over and around the potty seat 8. This action can cause the interior surface 130B of the multifunctional container 100, which previously shielded the child from the surfaces of the toilet 44, to surround potty seat 8, interior flap 134, and side panels 136.

Once the potty seat 8 is pulled back into the multifunctional container 100, the draw string 130 may be pulled, thereby enclosing the potty seat 8 within multifunctional container 100, as depicted in FIG. 2. Advantages of the disclosed embodiments can include, but are not limited to, being able to remove the potty seat 8 from the toilet 44 without touching the potty seat 8 following its use, folding the soiled internal surface 130B of the multifunctional container 100 (which was laid against the surfaces of the toilet 44) back into the multifunctional container 100, and retaining the cleanliness of the external surface 130A of the multifunctional container 100 as the exterior surface 130A was turned inside the multifunctional container 100 while the potty seat 8 was being used and is therefore not soiled or contaminated. Additional advantages can include the ability to quickly remove the potty seat 8 from the multifunctional container 100 (only one hand is needed), ease of cleaning to promote hygiene, storage of items in available pockets, and the ability to avoid touching any surface of the toilet 44 while positioning the potty seat 8 on the toilet seat 45 (one's hands can remains inside the multifunctional container 100 during setup and therefore not come into direct contact with the toilet 44).

Figure 7:
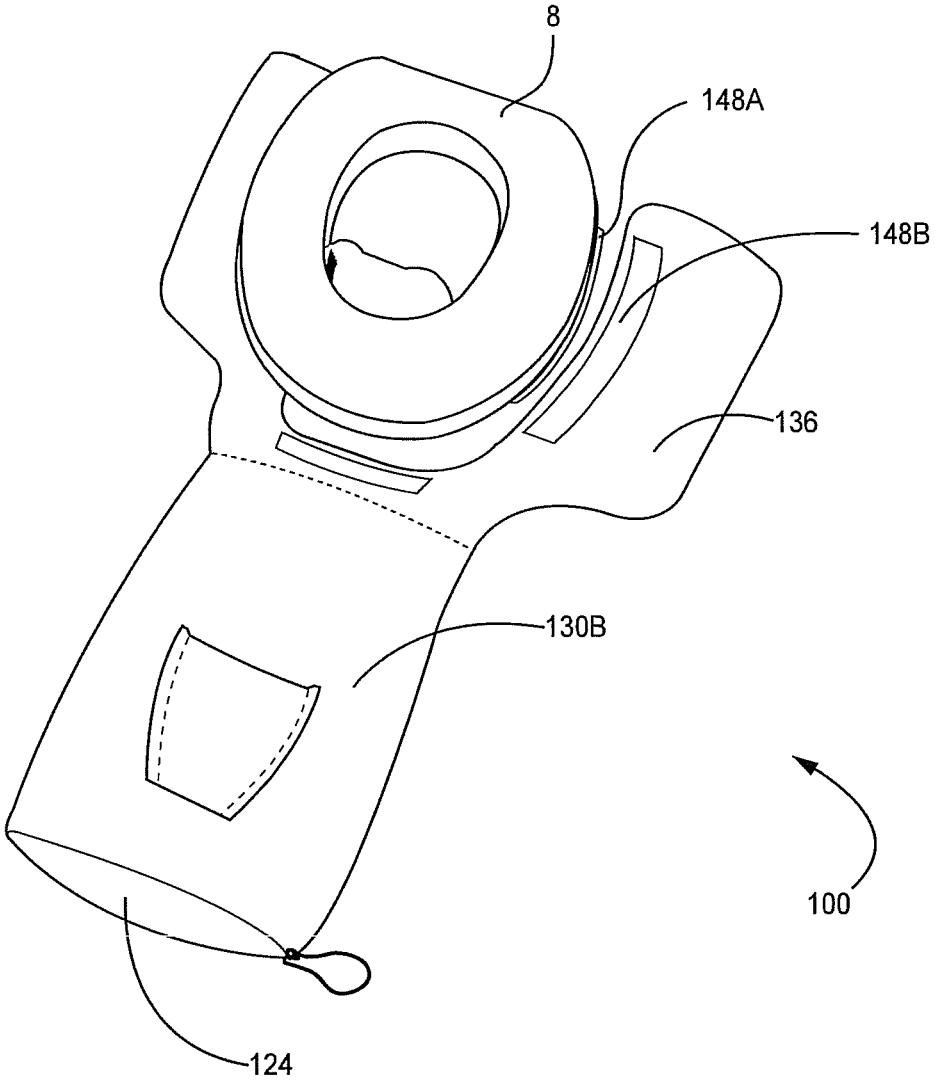
FIG. 7 is a perspective view of a potty seat being separated from an exemplary embodiment of a multifunctional container.

FIG. 7 illustrates a perspective view of an exemplary embodiment of multifunctional container 100 and potty seat 8, showing a manner in which the potty seat 8 may be detachably coupled or semi-permanently coupled to the multifunctional container 100. Detachably coupled or semi-permanently implies that the multifunctional container 100 can be easily detached from the potty seat 8 and subsequently reattached. For illustrative purposes as depicted in FIG. 7, the potty seat 8 is shown above the multifunctional container 100 thereby revealing potty seat fasteners 148A and a multifunctional container fasteners 148B. The fasteners 148A, 148B may be complementary to each other and can allow the multifunctional container 100 to be easily and conveniently removed from the potty seat 8 for cleaning.

Figure 8:
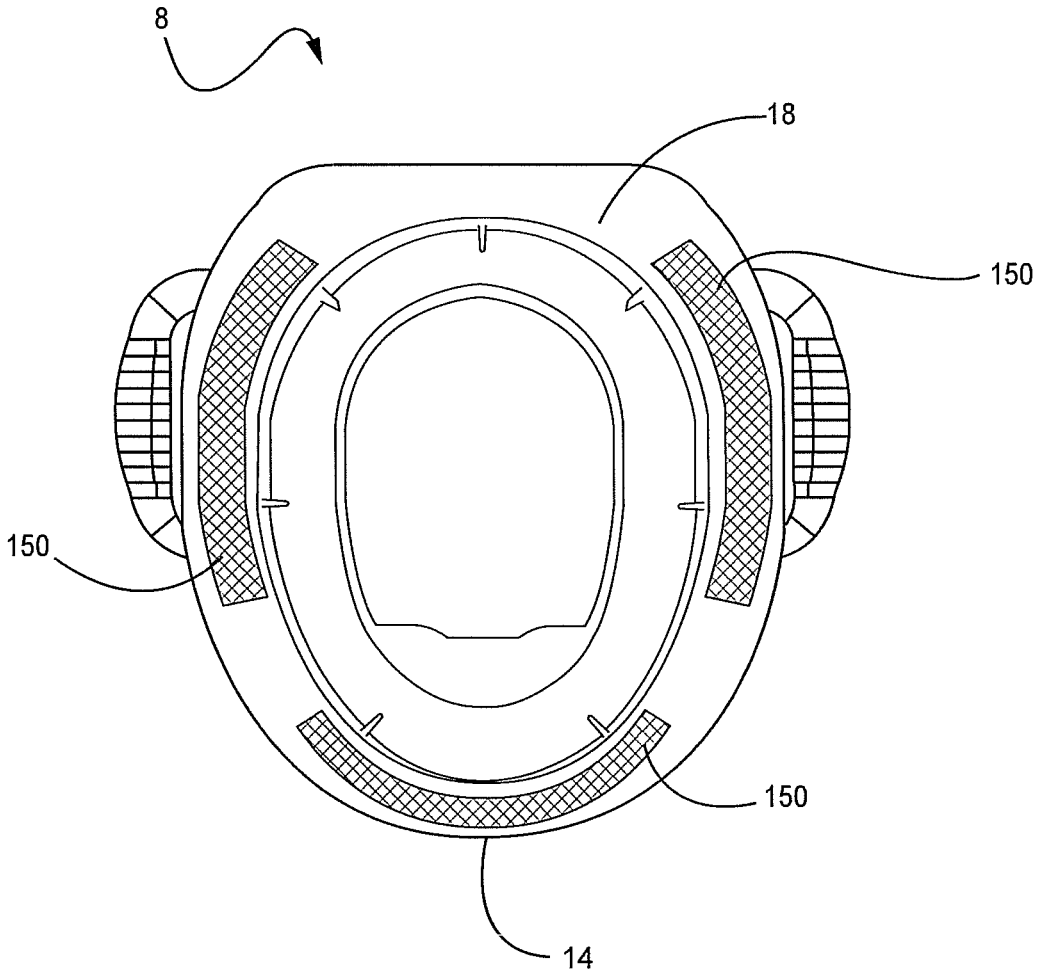
FIG. 8 illustrates the bottom of the potty seat with an exemplary embodiment of a multifunctional container removed thereby revealing a fastener facilitating the coupling of the multifunctional container to the potty seat.

FIG. 8 further illustrates the potty seat fasteners 148A of FIG. 7. In an embodiment of the invention, the potty seat fasteners 148A may be hook-and-loop fasteners 150. The hook-and-loop fasteners 150 can be positioned on the bottom surface 18 of the potty seat 8. The hook-and-loop fasteners 150 can be coupled to the bottom surface 18 with an adhesive such as tape or glue. Alternatively, the hook-and-loop fasteners 150 could be sewn or stapled to the bottom surface 18 of the potty seat 8. At least one hook-and-loop fastener 150 may be positioned at the front 14 of the potty seat 8 to facilitate attaching the potty seat 8 to the internal flap 134 of the multifunctional container 100. Similarly, a hook-and-loop fastener 150 may be positioned on the sides of the bottom surface 18 in order to attach the potty seat 8 to the side panels 136. (FIG. 7)

Those skilled in the art will recognize that hook-and-loop fasteners generally include a first orientation (the "hook") and a second orientation (the loop). In an exemplary embodiment of the invention, the "hook" portion of the hook-and-loop fasteners 150 may be coupled to the potty seat. This can facilitate maintaining the cleanliness of the multifunctional container 100 as the hook portions tend to attract particles. Thus, the hook portions may be better suited to be placed on the potty seat 8 as opposed to the multifunctional container 100, as multifunctional container 100 may be exposed to a multiplicity of different fabrics and particles, for example when the multifunctional container 100 is laundered.

Figure 9:
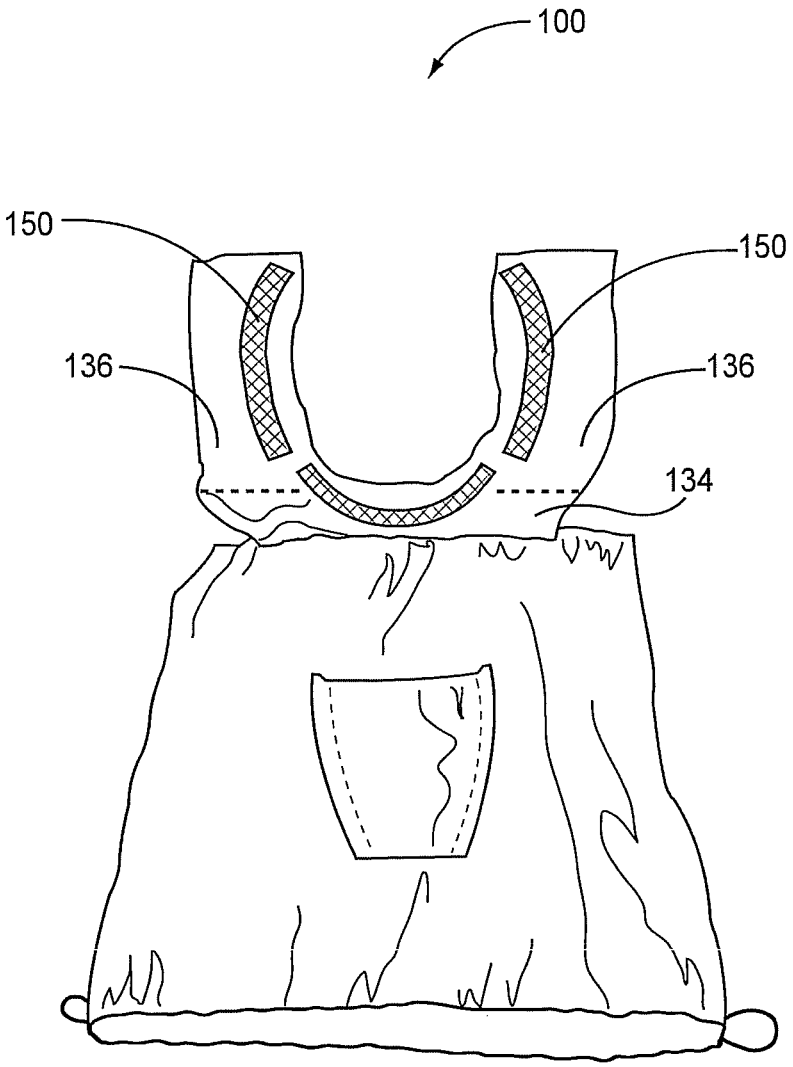
FIG. 9 illustrates an exemplary embodiment of a multifunctional container including side panels wherein the multifunctional container is turned inside out thereby revealing a fastener facilitating the coupling of the multifunctional container to the potty seat.

FIG. 9 shows an exemplary embodiment of the multifunctional container 100 turned inside out. Positioned on the internal flap 134 of the multifunctional container 100 may be the multifunctional container fasteners 148B (as shown in FIG. 7). In an embodiment of the invention corresponding to the embodiment disclosed in FIG. 8, the multifunctional container attachment means may be the loop portion of the hook-and-loop fasteners 150. The loop portion of the hook-and-loop fasteners 150 may be coupled to the multifunctional container 100 in a multiplicity of ways including, but not limited to, being sewn, adhesively coupled, or stapled. At least one loop portion of the hook-and-loop fastener 150 may be positioned on the internal flap 134. The loop portion of the hook-and-loop fastener 150 can connect to the corresponding hook portion of the hook-and-loop fastener 150 located at the front 14 of the potty seat 8. Similarly, the loop portion of the hook-and-loop fastener 150 can be positioned on the side panels 136 for attachment with the hook portion of the hook-and-loop fastener 150 located on the sides of the bottom surface 18 of the potty seat 8.

Figure 10:
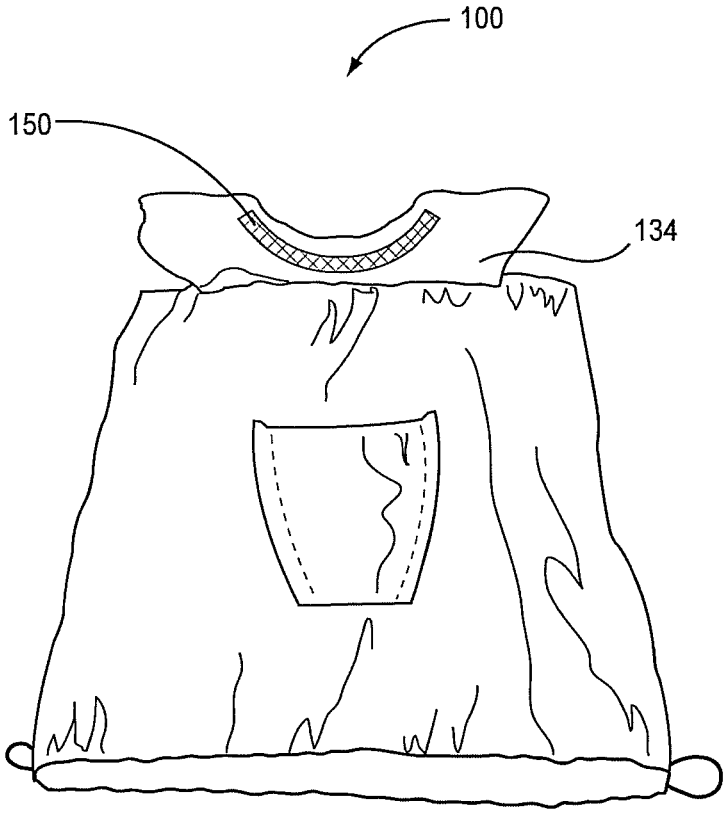
FIG. 10 illustrates an exemplary embodiment of a multifunctional container in an inside out position wherein the side panels are removed.

FIG. 10 illustrates an alternative exemplary embodiment of the multifunctional container 100 shown in FIG. 9. Here, the multifunctional container 100 does not include side panels 136 (See FIG. 9) and may selectively be constructed without including a pocket. The multifunctional container 100 can be detachably coupled to the potty seat 8 via the internal flap 134, which may be a continuous portion of the interior base 132. A loop portion of the hook-and-loop fastener 150 may be coupled to the internal flap 134. As illustrated above, the loop portion of the hook-and-loop fastener 150 can correspond to the hook portion of the hook-and-loop fastener 150 positioned on the front of the bottom surface 18 of the potty seat 8. (See FIG. 8)

Whereas the embodiments of the invention illustrated in FIGS. 8-10 use hook and loop fasteners for attaching the multifunctional container 100 to the potty seat 8, those skilled in the art will recognized that the attachment means can be achieved by using various couplers including, but not limited to, snaps, latches, buttons or magnets. Additionally, instead of using the internal flap 134 as an integral part of coupling the multifunctional container 100 to the potty seat 8, the multifunctional container fasteners 148B could be formed on or coupled directly or adjacent to the interior base 132 of the multifunctional container 100.

Figure 11B:
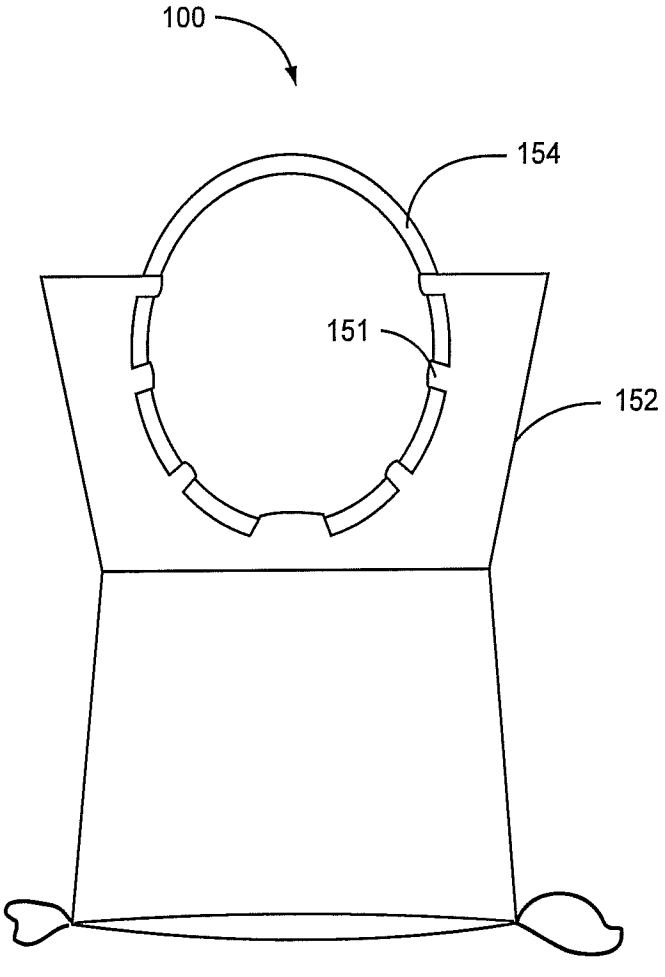
FIG. 11B illustrates an exemplary embodiment of a multifunctional container wherein the elastic band has greater exposure to the support ring of the potty seat.
Figure 11A:
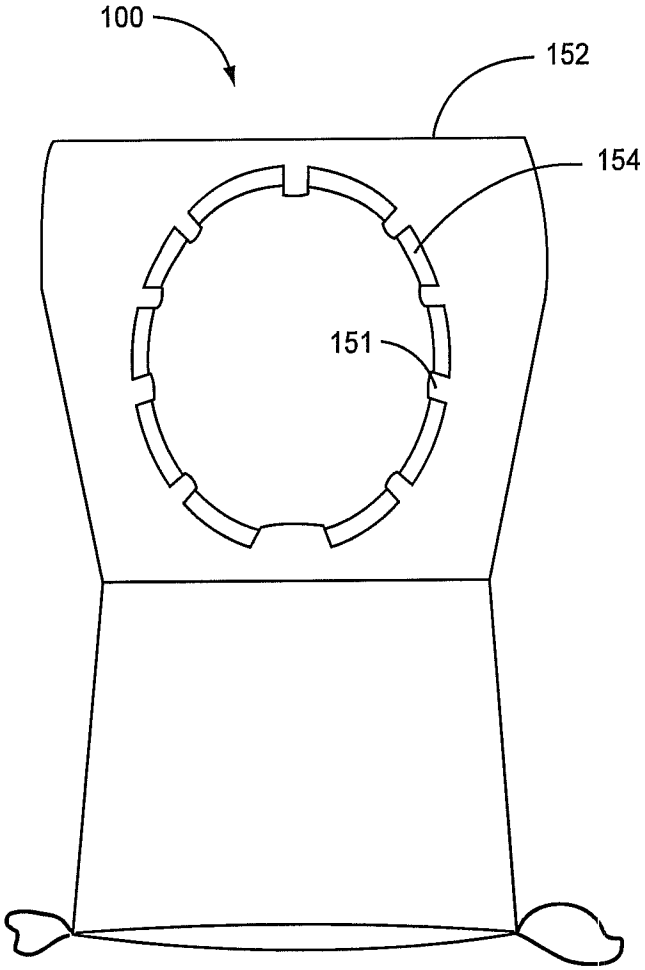
FIG. 11A illustrates an exemplary embodiment of a multifunctional container wherein an elastic band is used to attach the multifunctional container to the potty seat.
Figure 11D:
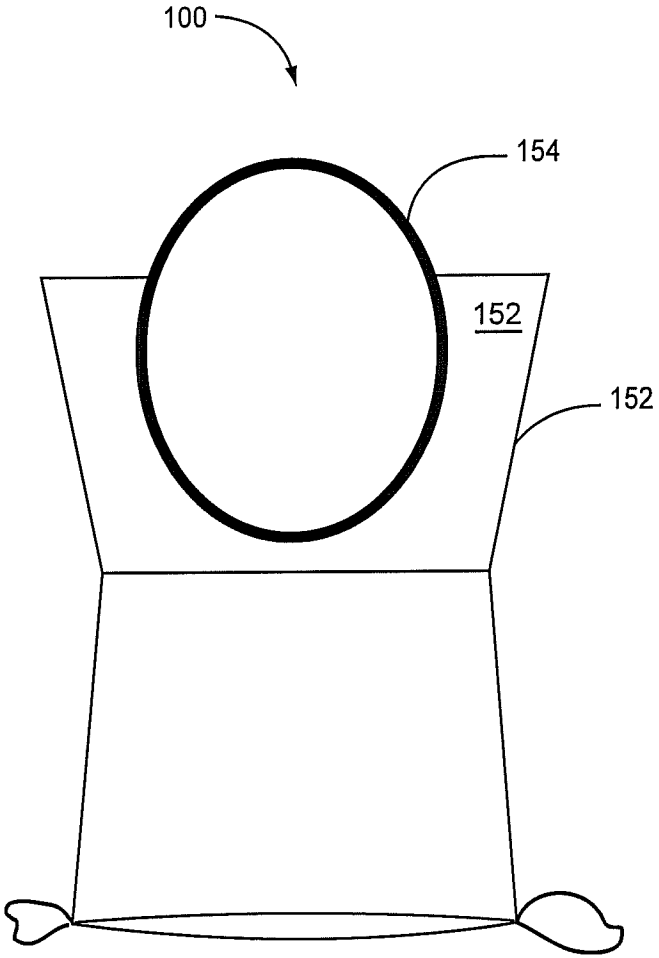
FIG. 11C-D illustrates an exemplary embodiment of a multifunctional container wherein the elastic band has full exposure to the support ring of the potty seat.
Figure 11C:
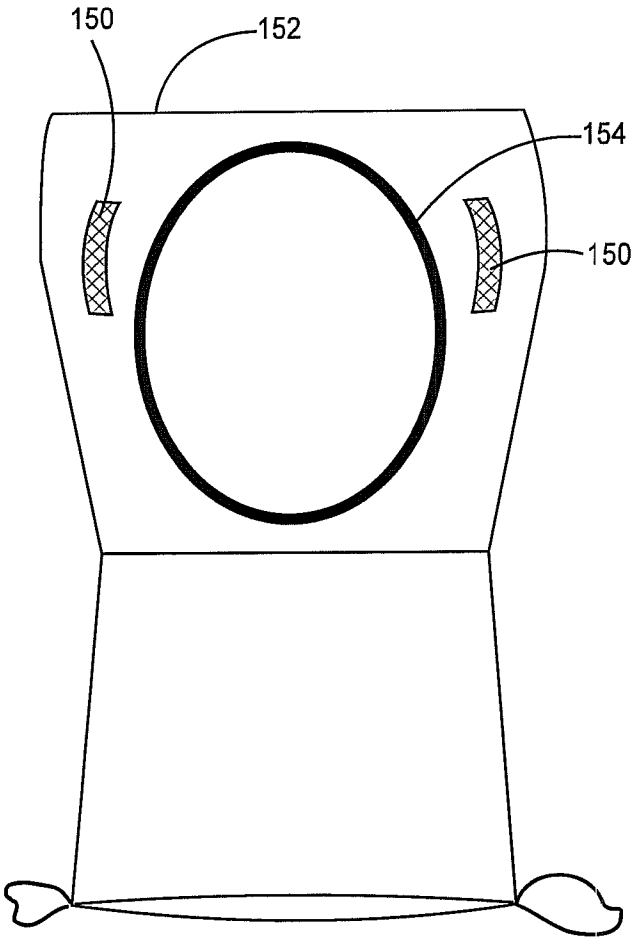

FIG. 11A illustrates another exemplary embodiment of the multifunctional container 100. Here, the multifunctional container 100 is turned inside out. In this embodiment, the internal flap 134 and the side panels 136 may be combined thereby creating an extended internal flap 152. Portions, such as loops 151, of the extended internal flap 152 may be looped around an elastic band 154. The elastic band 154 can have a diameter that is less than the diameter of the support ring 20 of the potty seat 8. The multifunctional container 100 may be coupled to the potty seat 8 by expanding the elastic band 154 and placing it over the support ring 20. The elastic band 154 may be made of rubber, plastic, or other fibrous materials and could be coated with substances that will enhance the grip to the potty seat 8. In another exemplary embodiment, as shown in FIG. 11B, a portion of the elastic band 154 is not covered by the extended internal flap 152. This can provide increased adhesion of the elastic band 154 to the support ring 20, due to a greater portion of the elastic band 154 being exposed to the support ring 20. Those skilled in the art will recognize that the elastic band 154 may be fully exposed for adhesion to the support ring 20, as shown in FIGS. 11C and 11D, wherein the elastic band 154 may be sewn directly onto extended internal flap 152 of multifunctional container 100. Alternatively, this embodiment may also include a multifunctional container fastener 148B; such as a hook-and-loop fastener 150.

Figure 12:
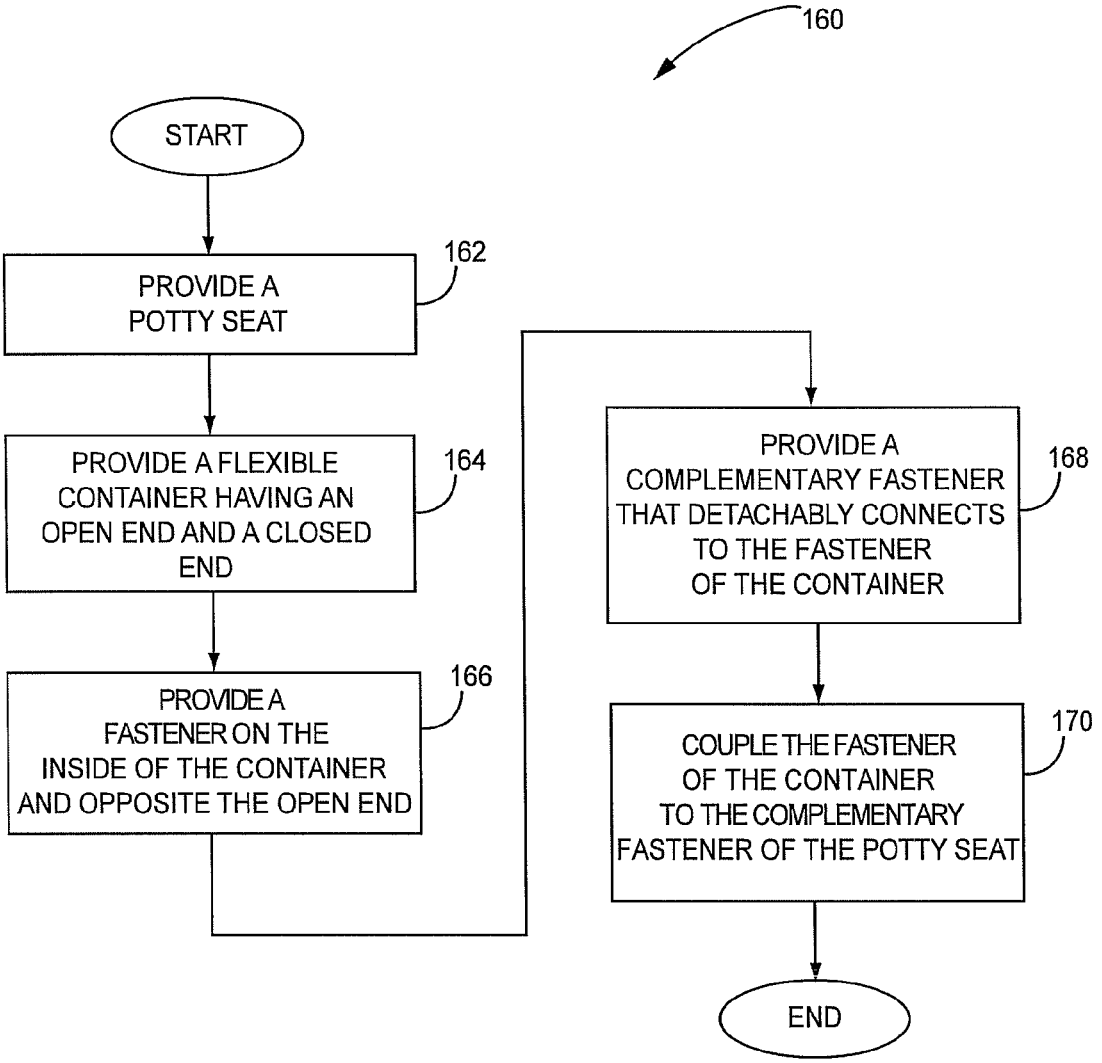
FIG. 12 shows a block diagram for an exemplary method of shielding the surfaces of a toilet.

FIG. 12 shows an exemplary method 160 for shielding a child from the unsanitary conditions of a toilet. At step 162, a potty seat having a front portion and a rear portion may be provided. At step 164, a flexible container of sufficient size to contain the potty seat may be provided. The container may include at least one open end and a closed end. At step 166, a fastener may be provided on the container opposite the open end of the container. At step 168, a complementary fastener may be provided on the potty seat, the complementary fastener adapted to detachably connect to the fastener of the container. At step 170, the fastener may be coupled to the complementary fastener, adjacent to the closed end and opposite the open end of the interior of the flexible container.

The second attachment means of the second orientation may be permanently or semi-permanently attachable to at least the front portion of the potty seat.

Figure 1C:
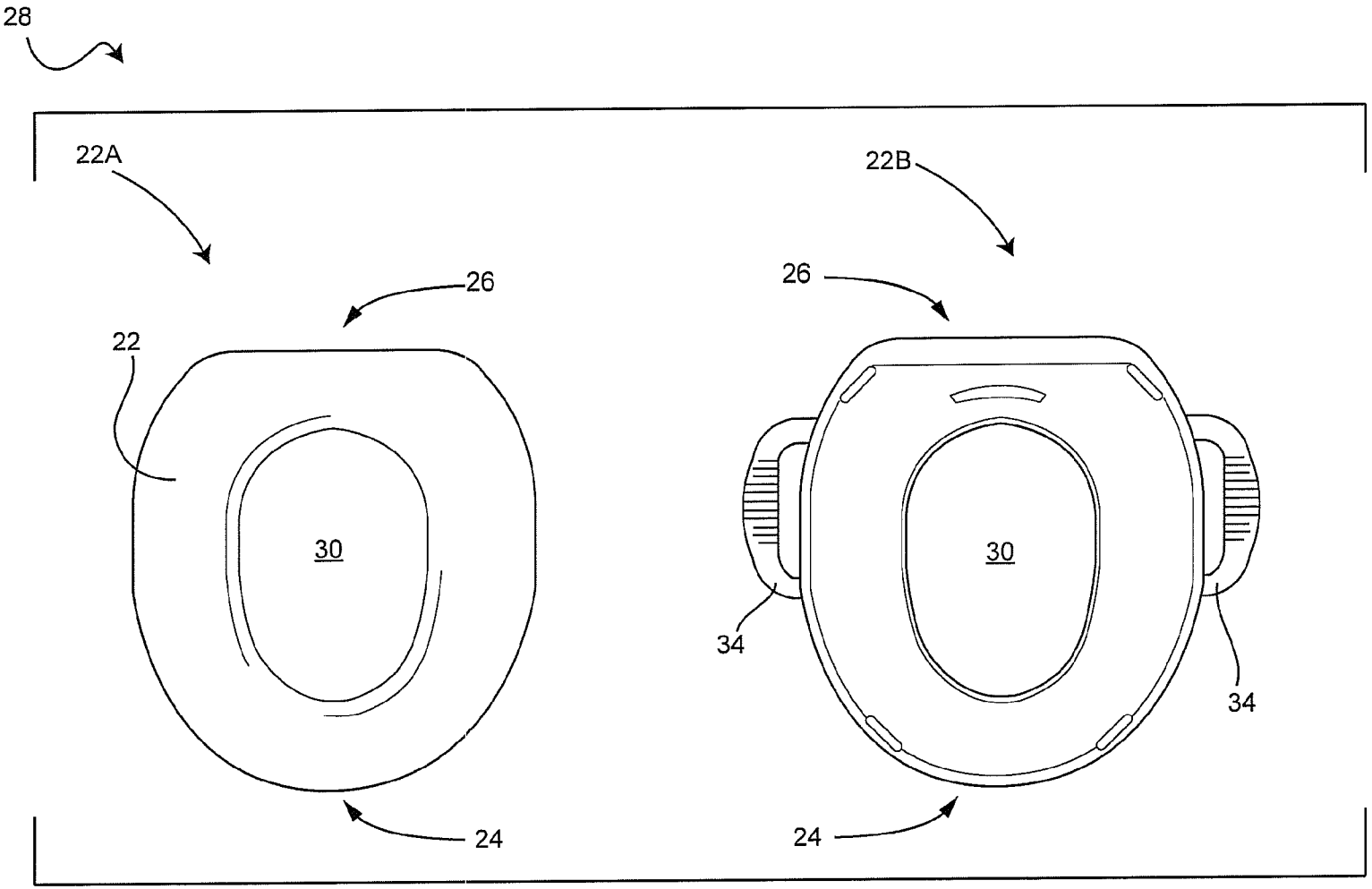
FIGURE 1C (RELATED ART)
FIG. 1C is a top surface view of a potty seat removable pad on which a child sits and a potty seat base to which the removably pad may be removably coupled.
Figure 1D:
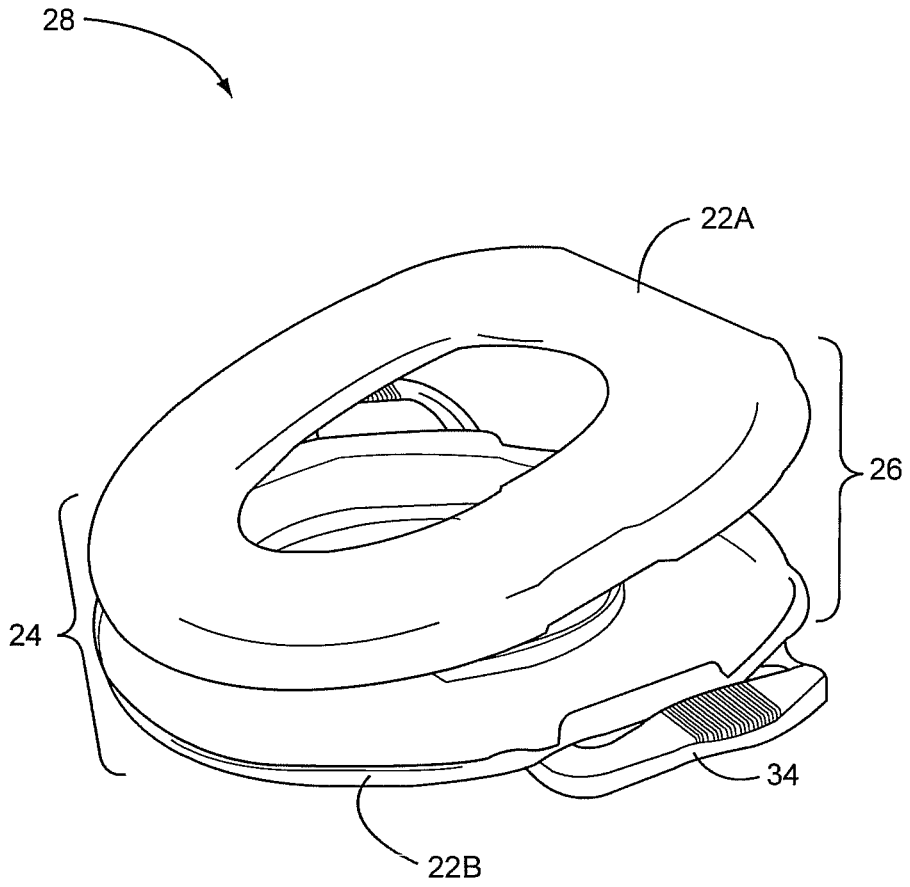
FIGURE 1D (RELATED ART)
FIG. 1D is a top surface view of the potty seat of FIG. 1C which illustrates the removable pad being coupled to the potty seat base.

FIGS. 1C-1D show an additional exemplary embodiment of a potty seat 28. The potty seat 28 can have removable pad 22A removably coupled to a potty seat base 22B. Each of removable pad 22A and potty seat base 22B can have a ring-shaped perimeter surrounding a main aperture 30. Removable pad 22A can further have a top surface 22, which may be soft, on which the child sits. The potty seat can further include a pair of handles 34. The front 24 of the potty seat 28 can be substantially curved and the rear 26 of the potty seat 28 can be generally straight. The bottom of the seat can be substantially similar to the embodiment shown in FIG. 1B. An advantage of this embodiment is that the removable pad 22A can be cleaned separately from the potty seat base 22B. In conjunction with such an embodiment, the multifunctional container can be securely disposed in-between the potty seat base 22B and removable pad 22A. When the removable pad 22A and potty seat base 22B are coupled or snapped together, a portion of the multifunctional container can become wedged in between the two parts. This embodiment therefore mitigates the need for placing Velcro on the multifunctional container 100 and potty seat 28 for attachment purposes.

Figure 13A:
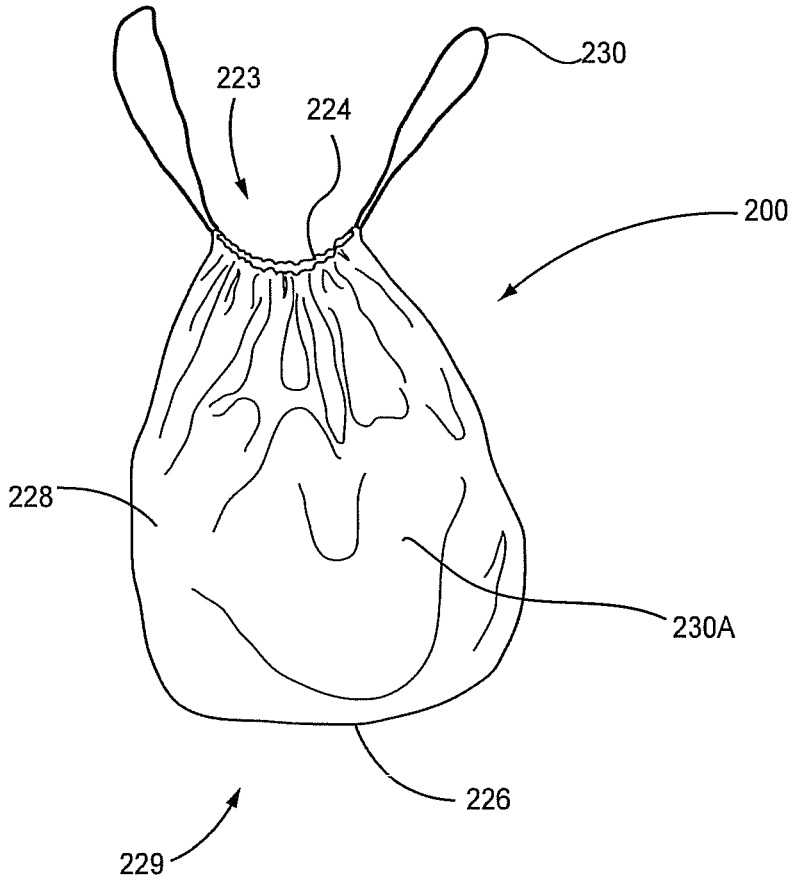
FIG. 13A illustrates another exemplary embodiment of a multifunctional container.
Figure 13B:
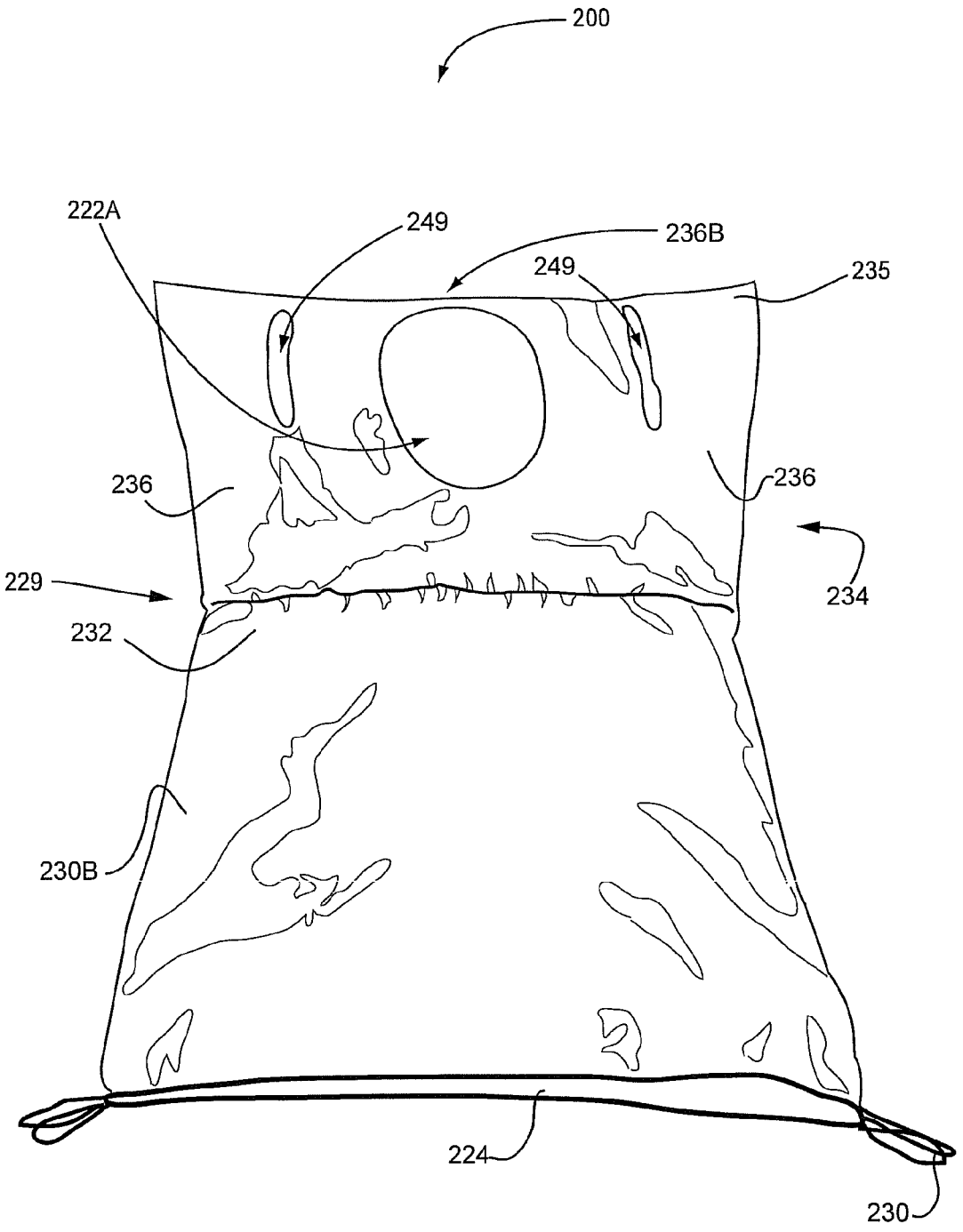
FIG. 13B illustrates another exemplary embodiment of a multifunctional container that is turned inside out, thereby revealing an interior flap which allows the multifunctional container to be placed in between the removable pad and potty seat base.

FIGS. 13A-13B show an embodiment of the multifunctional container 200 that may be adapted to the potty seat 28 shown in FIGS. 1C-1D. The multifunctional container 200 can have a predetermined volume sufficient to contain the potty seat 28 and an opening 224 through which the potty seat can be extracted and inserted. The opening 224 can be located at a first end 223 of the container 200. The exterior of multifunctional container 200 can be substantially similar to the exterior of multifunctional container 100. Thus, the multifunctional container 200 can further include an exterior base 226 and a sidewall 228 enclosing an interior cavity of container 200. The exterior base 226 can be located at a second end 229 of the container 200 substantially opposite the opening. In some exemplary embodiments, the sidewall 228 and exterior base 226 of the multifunctional container 200 can be permanently coupled to each other. Those skilled in the art, however, will recognize that the sidewall 228 and exterior base 226 could be coupled using zippers or any other fastener known in the art. Moreover, in an exemplary embodiment of the invention, the opening 224, when expanded, can be wider than the exterior base 226, thereby making it easier to maneuver the potty seat 28 in and out of the multifunctional container 200. In yet another exemplary embodiment of the invention, the multifunctional container 200 can include straps (not shown) that allow the multifunctional container 200 to be carried as a backpack or book bag.

The opening 224 of the multifunctional container 200 can be selectively closable and can include drawstring 230. The drawstring 230 may allow the opening 224 of the multifunctional container 200 to be fully opened or securely closed. Once the multifunctional container 200 is fully opened, the potty seat 28 can be freely inserted into the multifunctional container 200 or partially or fully removed from the multifunctional container 200. Alternatively, those skilled in the art will recognize that instead of using a drawstring 230, other suitable material may be used to close the opening 224 of the multifunctional container 200 including, but not limited to, Velcro, magnets, twists, handles, zippers, buttons, snaps, and ties.

Multifunctional container 200 can further include an exterior surface 230A and an interior surface 230B. For example, the sidewall 228 may have an exterior surface 230A and interior surface 230B. In an embodiment of the invention, the exterior surface 230A and the interior surface 230B may be made of different materials which are sewn, glued, pressed, or meshed together. For example, in an embodiment of the invention, the interior surface 230B may be made from or treated with an antimicrobial material whereas the exterior surface 230A may be made from a designer fabric with aesthetic appeal. Since the interior surface 230B of the multifunctional container 200 touches the potty seat 28 and, as explained supra, the surfaces of the toilet 44, the antimicrobial material can kill or inhibit the growth of bacteria originating from these surfaces.

In some exemplary embodiments, the interior surface 230B of the multifunctional container 200 may be made of material including, but not limited to, vinyl, canvas, nylon, polyester, plastic, or other water resistant or waterproof material capable of being easily cleaned or sanitized with disinfecting wipes. The exterior surface 230A may be made from material that has a greater aesthetic appeal such as cotton, nylon, leather, silk, fleece, velour, chenille, or suede. Notwithstanding the foregoing, to aid in reducing manufacturing costs, one skilled in the art will recognize that the exterior surface 230A and the interior surface 230B can be made of the same material or unitary fabric. In some exemplary embodiments, a pocket (not shown) may be disposed on the interior surface 230B of multifunctional container 200, substantially as described in the embodiment of multifunctional container 100.

FIG. 13B shows the multifunctional container 200 turned inside-out. The multifunctional container 200 can include an interior base 232 and an internal flap 234. In some exemplary embodiments, the internal flap 234 may be coupled to the interior base 232 at second end 229 of the multifunctional container 200. In other exemplary embodiments, the interior flap 234 can be a continuous, unitary part of the interior base 232 of the multifunctional container 200. Internal flap 234 may have a first end 235 extending away from second end 229 of multifunctional container 200.

Interior flap 234 can include a pair of opposing side panels 236 and a side panel connector 236B extending between the side panels substantially at the free end of interior flap 234. An aperture 222A may be defined between side panels 236 and connector 236B. The aperture 222A can be sized and shaped similarly to main aperture 30 of potty seat 28. Interior flap 234 can further include a pair of handle cutouts 249. The handle cutouts 249 can be sized and shaped to receive handles 34 of potty seat 28.

Figure 14:
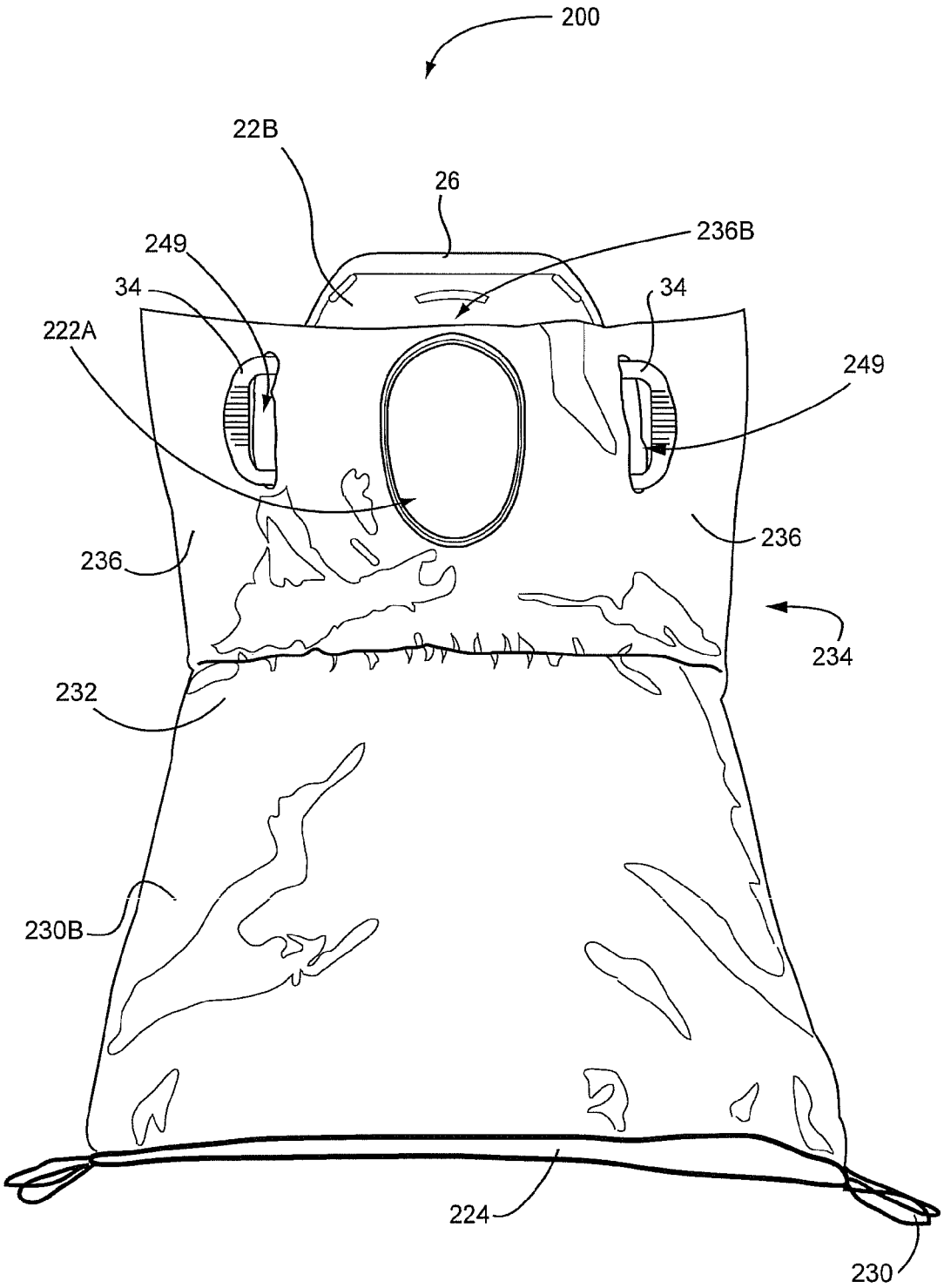
FIG. 14 illustrates another exemplary embodiment of a multifunctional container placed on the potty seat base wherein the handles are inserted into the hand cutouts and the container aperture is aligned with the main aperture of the potty seat.

FIG. 14 shows multifunctional container 200 being placed on top of the potty seat base 22B. The handles 34 of the potty seat base 22B can inserted into the handle cutouts 249. The aperture 222A may be placed proximate the potty seat main aperture 30. The side panels 236 and side panel connector 236B can allow the interior flap 234 to surround the potty seat main aperture 30 and reduce the likelihood of flap 234 interfering with the main aperture 30.

Figure 15:
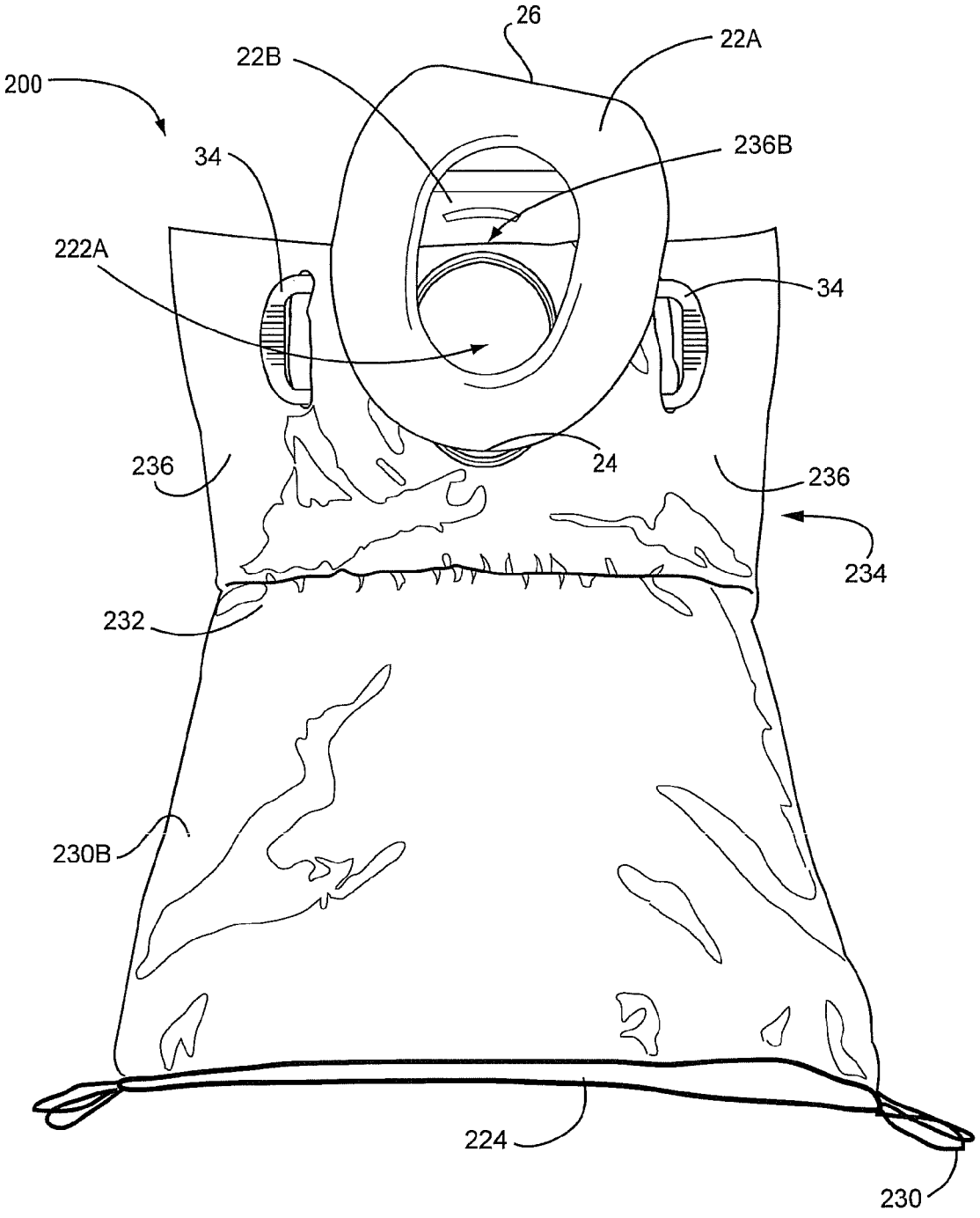
FIG. 15 illustrates another exemplary embodiment of a multifunctional container wherein the removable pad is placed over the multifunctional container hole and side panel connector.
Figure 16:
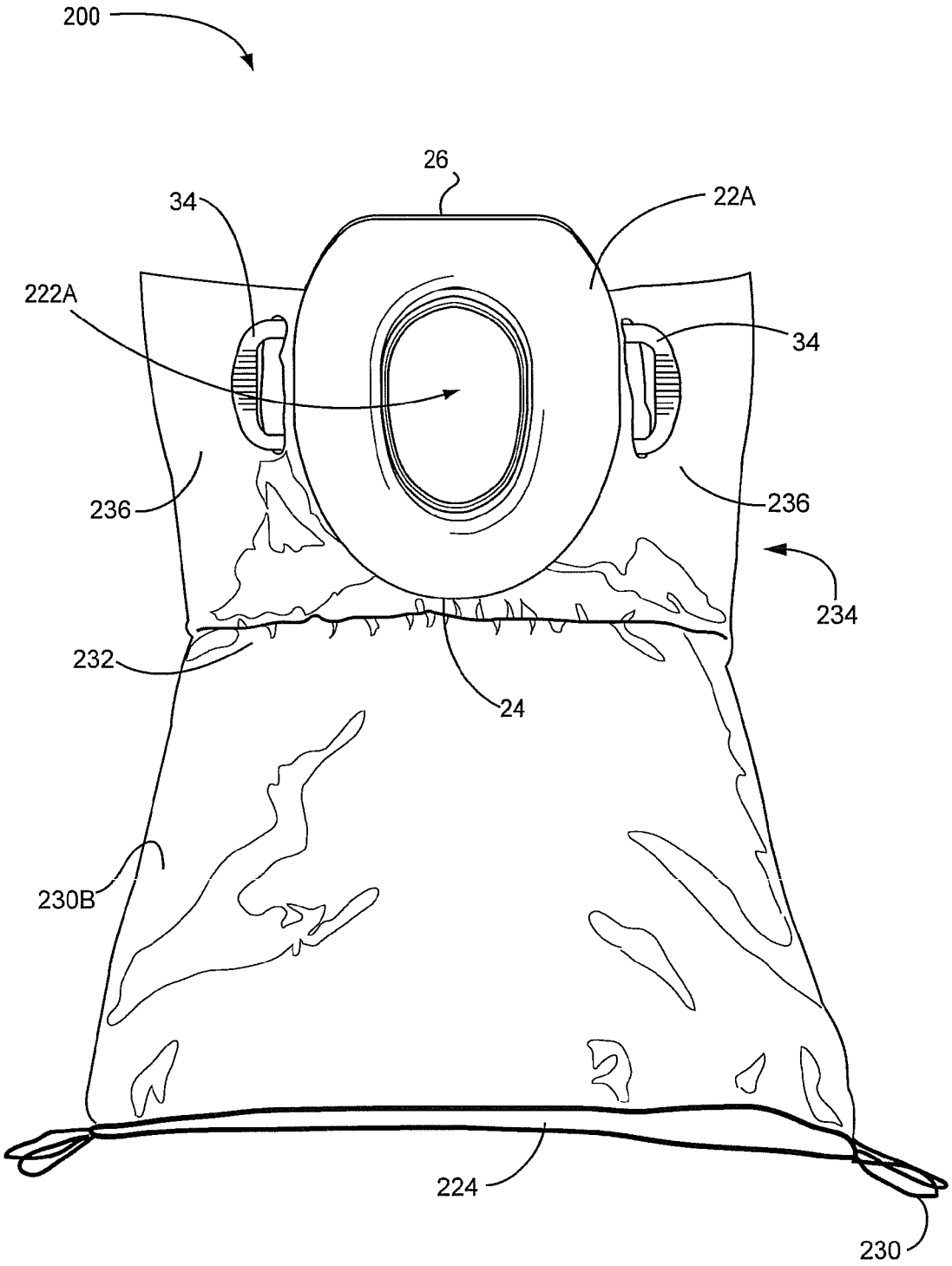
FIG. 16 illustrates another exemplary embodiment of a multifunctional container securely coupled or pinched in-between the removable pad and potty seat base when the removable pad and potty seat base are coupled together.

In FIG. 15, the removable pad 22A may be placed on top of the potty seat base 22B, side panels 236 and side panel connector 236B. In an embodiment of the potty seat 28, the removable pad 22A can be configured to snap onto potty seat base 22B. Accordingly, once the side panels 236 and side panel connector 236B are positioned on the potty seat base 22B as previously described, the removable pad 22A may then be snapped onto the potty seat base 22B thereby securing the multifunctional container 200 to the potty seat 28 (See FIG. 16).

In operation, the multifunctional container 200 in conjunction with the potty seat can be used substantially similar to the embodiment of multifunctional container 100, as described above and shown in FIGS. 3-6.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art. For example, those skilled in the art will recognize that the multifunctional container can be made of a disposable material such as, but not limited to, paper products, plastic, and recycled materials.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A portable potty seat system for use with a toilet, the portable potty seat system comprising:

a portable potty seat configured to be placed on a seat of the toilet such that a front of the portable potty seat is oriented towards a front of the toilet;

a container for the portable potty seat comprising:

a first end having an opening defined therein;

a second end disposed opposite the opening;

a sidewall extending between the first end and the second end, and defining an interior cavity between the first end, the second end, and the sidewall;

an interior surface;

an exterior surface; and an internal flap coupled to and extending away from the second end of the container, the internal flap detachably coupled to a portion of the portable potty seat such that the internal flap extends away from the front of the portable potty seat, wherein the container is formed from a flexible material such that:

when the exterior surface of the container is exposed, the internal flap is disposed within the interior cavity of the container and the portable potty seat is disposed within the interior cavity;

when the container is turned inside-out, the interior surface of the container is exposed and the portable potty seat is extended through the opening; and when the portable potty seat is placed on the seat of the toilet, the container extends downwards from the portable potty seat to cover at least a portion of the front of the toilet.

2. The container of claim 1, wherein the internal flap further comprises:

a first aperture defined therein, the first aperture having a diameter substantially similar to a main aperture of the portable potty seat; and a pair of second apertures defined therein and arranged peripherally to the first aperture, each of the second apertures being sized and shaped to receive a handle of the portable potty seat.

3. The container of claim 1, wherein the internal flap further comprises at least one fastener adapted to detachably couple to a portion of the portable potty seat.

4. The container of claim 1, wherein the internal flap further comprises an annular elastic band adapted to detachably couple to a portion of the portable potty seat.

5. The container of claim 1, wherein the internal flap is sized and shaped to be wedged between a removable pad of the portable potty seat and a base of the portable potty seat.

6. The container of claim 1, wherein the interior surface and the exterior surface are formed from different materials.

7. The container of claim 1, wherein the first end further comprises a closure for opening and closing the opening.

8. The container of claim 1, further comprising at least one pocket disposed on the sidewall.

9. A portable potty seat system for use with a toilet, the portable potty seat system comprising:

a portable potty seat configured to be placed on a seat of the toilet such that a front of the portable potty seat is oriented towards a front of the toilet; and a container for the portable potty seat comprising:

a first end having an opening defined therein, a second end disposed opposite the opening;

a sidewall extending between the first end and the second end, and defining an interior cavity between the first end, the second end, and the sidewall;

an interior surface;

an exterior surface; and an internal flap coupled to and extending away from the second end of the container, the internal flap detachably coupled to a portion of the portable potty seat such that the internal flap extends away from the front of the portable potty seat and comprising an aperture that is substantially similar to a main aperture of the portable potty seat such that when the internal flap is coupled to the portable potty seat the aperture of the internal flap and the main aperture of the portable potty seat are substantially aligned, wherein the container is formed from a flexible material such that:

when the exterior surface of the container is exposed, the portable potty seat is disposed within the interior cavity;

when the container is turned inside-out, the interior surface of the container is exposed and the portable potty seat is extended through the opening; and when the portable potty seat is placed on the seat of the toilet, the container extends downwards from the portable potty seat to cover at least a portion of the front of the toilet.

10. The portable potty seat system of claim 9, wherein:

the internal flap of the container further comprises at least one fastener disposed thereon; and the portable potty seat further comprises at least one complementary fastener configured to couple to the at least one fastener of the internal flap.

11. The portable potty seat system of claim 9, wherein:

the portable potty seat further comprises a support ring; and the internal flap further comprises an annular elastic band adapted to detachably couple to the support ring of the portable potty seat.

12. The portable potty seat system of claim 9, wherein:

the portable potty seat further comprises a base and a removable pad detachably coupled to the base;

the internal flap is configured to be wedged between the base and the removable pad; and the internal flap further comprises a first aperture defined therein, the first aperture having a diameter substantially similar to a main aperture of the portable potty seat.

13. The portable potty seat system of claim 12, wherein:

the portable potty seat further comprises a pair of handles; and the internal flap further comprises a pair of second apertures defined therein, each of the second apertures being sized and shaped to receive a handle of the portable potty seat.

14. The portable potty seat system of claim 9, wherein the interior surface and the exterior surface are formed from different materials.

15. The portable potty seat system of claim 9, wherein the first end of the container further comprises a closure for opening and closing the opening.

16. The portable potty seat system of claim 9, wherein the container further comprises at least one pocket disposed on the sidewall.

17. A method for transporting and using a portable potty seat comprising:

providing the portable potty seat;

providing a flexible container for the portable potty seat comprising:

a first end having an opening defined therein;

a second end disposed opposite the opening;

a sidewall extending between the first end and the second end, and defining an interior cavity enclosed by the first end, the second end, and the sidewall;

an interior surface;

an exterior surface; and an internal flap coupled to and extending away from the second end of the container, the internal flap detachably coupled to a portion of the portable potty seat such that the internal flap extends away from the front of the portable potty seat;

inserting the front end of the portable potty seat through the opening of the container;

coupling the portable potty seat to the internal flap of the container;

enclosing the portable potty seat in the interior cavity of the container;

turning the container inside-out to expose the interior surface of the container and extending the portable potty seat through the opening; and placing the portable potty seat on the seat of a toilet such that the container extends downwards from the portable potty seat to cover at least a portion of the front of the toilet.

18. The method of claim 17, further comprising:

wedging the internal flap between a base and a removable pad of the portable potty seat; and placing a first aperture defined in the internal flap proximate a main aperture of the portable potty seat.

19. The method of claim 17, further comprising placing at least one handle of the portable potty seat into at least one second aperture defined within the internal flap.

20. The container of claim 7 wherein the closure is a drawstring.

21. The portable potty seat system of claim 15 wherein the closure is a drawstring.

* * * * *